US006019143A

United States Patent [19]

Marik et al.

[11] Patent Number: 6,019,143

[45] Date of Patent: Feb. 1, 2000

[54] ORIENTATION MEANS FOR CABLE TIE DELIVERY SYSTEM

[75] Inventors: Greg Marik, Germantown; Julio F. Rodrigues; John J. Students, both of Collierville, all of Tenn.

[73] Assignee: Thomas & Betts International, Inc., Sparks, Nev.

[21] Appl. No.: 09/197,289

[22] Filed: Nov. 20, 1998

Related U.S. Application Data

[60] Provisional application No. 60/066,323, Nov. 21, 1997.

[51] Int. Cl.[7] ..... B21F 9/02

[52] U.S. Cl. ..... 140/93.2; 221/171

[58] Field of Search ..... 140/93 A, 93.2; 221/171, 172, 173

[56] References Cited

U.S. PATENT DOCUMENTS 3,976,108 8/1976 Caveney et al. .

4,790,225 12/1988 Moody et al. .

4,862,928 9/1989 Caveney et al. ..... 140/93.2

5,140,880 8/1992 Littleton .

5,909,751 6/1999 Teagno ..... 140/93.2

*Primary Examiner*—Lowell A. Larson

*Attorney, Agent, or Firm*—Hoffmann & Baron, LLP

[57] ABSTRACT

An improved orientation means for a cable tie delivering system is adapted to complement a cable tie delivery system and includes an elongated conduit for orientation of an elongated, generally planar cable tie therein. The elongated conduit orients either a symmetrical or a single-directional cable tie in a delivery hose extending between a cable tie application tool and a dispenser from which such a cable tie is ejected. The conduit achieves proper orientation of the cable tie by requiring the cable tie to bend as it travels from the dispenser to the tool. By confining the cable tie once it has achieved the desired orientation the conduit retains the cable tie therein for accurate delivery to the installation tool and proper application to a bundle of articles to be tied.

9 Claims, 10 Drawing Sheets

ORIENTATION MEANS FOR CABLE TIE DELIVERY SYSTEM

This application claims the benefit of the filing date of U.S. Provisional Application No. 60/066,323, filed Nov. 21, 1997 and entitled "ORIENTATION MEANS FOR CABLE TIE DELIVERY SYSTEM".

FIELD OF THE INVENTION

The present invention relates generally to an apparatus which dispenses and applies a cable tie about a bundle of wires or similar objects. More particularly, the present invention relates to an apparatus for orienting and aligning a cable tie prior to delivery of the cable tie to a cable tie installation tool.

BACKGROUND OF THE INVENTION

Application and installation tools for applying cable ties to a bundle of wires or similar objects are well-known. These tools are designed to apply an elongate cable tie having a strap body and a head at one end thereof about the bundle. A tail of the cable tie body is fed through an aperture in the head and the cable tie is tensioned around the bundle of wires by the tool. The tool then provides for cutting the tail from the cable tie body, leaving the cable tie securely cinched around the bundle of wires. The cable tie application tool can provide fast and repetitive application of cable ties to wire bundles in an assembly line type process.

Referring to FIGS. 1, 2A and 2B, a cable tie delivery system 1 is designed to feed an individual cable tie 12 to a tool 7 from a reel 5 of cable ties supported by a dispenser 3. The dispenser 3 provides for cutting of an individual cable tie from the reel and feeding the individual cable tie from the dispenser to the tool. Such feeding is typically accomplished under pneumatic pressure where the cable tie is delivered from the dispenser 3 to the tool 7 by a conduit or delivery hose 9.

Cable tie 12 includes a head 12*a*, a strap body 12*b* and a tail 12*c* and is known in the art as a symmetrical cable tie. As may be appreciated, in order to accurately apply the cable tie 12 around the bundle of wires and to feed the tail 12*c* through an aperture 12*d* in the head 12*a*, the cable tie must be correctly positioned and oriented in the tool. Such orientation is typically provided at the dispenser 3 so that the cable tie is fed into the delivery hose 9 in a proper orientation. The cable tie maintains this proper orientation throughout its transport in the delivery hose by providing a delivery hose which is configured in cross-section to match the cross-sectional configuration of the cable tie head 12*a* as illustrated in FIG. 3A. Such configuration is generally rectangular and slightly larger than the square head of the tie so that the cable tie head 12*a* is positionally retained within the hose 9. This prevents the tie from rotating while it is propelled through the hose by compressed air and ensures proper head position at installation.

While such an arrangement provides for the accurate orientation of the cable tie with respect to the tool by providing a delivery hose which closely conforms to the shape of the cable tie head, such construction is not without problems. It has been found that such a relationship between the delivery hose and the cable tie configuration may result in higher incidences of jamming of the cable tie in the hose. Due to the close fit between the cable tie head and the cross-sectional shape of the hose, any interruption in the hose such as may be caused by small pieces of dirt or debris or kinks in the hose serve to increase the likelihood of jamming of the cable in the hose. Such problems are not usually present where the cable tie is delivered via a round delivery hose of cylindrical cross-section, as illustrated in FIG. 3B, in that there is sufficient space between the cable tie head 12*a* and the interior or surface of hose 9 to permit the cable to bypass any potential jams. However, use of such a hose permits the cable tie to rotate during delivery, losing the cable tie orientation which was originally provided by the dispenser.

It is, therefore, desirable to provide an apparatus for use within a cable tie delivery system by which a cable tie may be reoriented prior to entering a cable tie installation tool and retained in the reoriented position to prevent jamming within the delivery system and to further prevent improper firing of the tool. It is further desirable to provide such a system where reorientation can be performed on either a symmetrical or single directional cable tie.

SUMMARY OF THE PRESENT INVENTION

It is an object of the present invention to provide an improved orientation means which ensures delivery of a cable tie to a cable tie installation tool in a proper orientation for application to a bundle of articles.

It is another object of the present invention to provide an improved orientation means which ensures proper orientation of both symmetrical and single-directional cable ties.

It is still another object of the present invention to provide a cable tie orientation device which repeatedly configures a cable tie into proper firing position regardless of the orientation of the tie as it enters the orientation device.

In the efficient attainment of these and other objects, the present invention provides an easily machinable orientation apparatus wherein a cable tie is oriented into a position for proper firing from a cable tie installation tool and subsequent proper application about a bundle of articles. The apparatus includes an orientation conduit which permits delivery of a cable tie from a dispenser to an application tool through a delivery hose connected therebetween, wherein the cable tie has an elongate, generally planar body and an enlarged head at an extremity thereof. The conduit comprises an elongate chute having a cable tie receiving first open end and a cable tie dispensing second open end with an unobstructed passage therebetween. The passage parameters are defined by an interior surface of the chute, which may have one or more bent extents therein or a pair of helical spirals protruding therefrom. The contour of the interior surface is selected to accommodate rotation and translation of a cable tie through the chute and depends upon whether the cable tie is of symmetrical or single-directional configuration.

DETAILED DESCRIPTION OF THE PREFERRED EMBODIMENTS

The present invention provides for a device which orients a cable tie in a delivery hose extending between a cable tie application tool and a dispenser where the delivery hose is round or of circular cross-sectional configuration. The present invention achieves such orientation by providing an elongate substantially rigid chute which effectively requires the cable tie to bend or deflect as the tie travels from the dispenser to the tool through the delivery hose. Due to the construction of the cable tie, such deflection or bending of the cable tie may be readily achieved only in one orientation. By confining the cable tie once it has been subject to bending or deflection in an oriented position, the cable tie can be accurately delivered to the tool in a desired orientation.

Figure 2A:
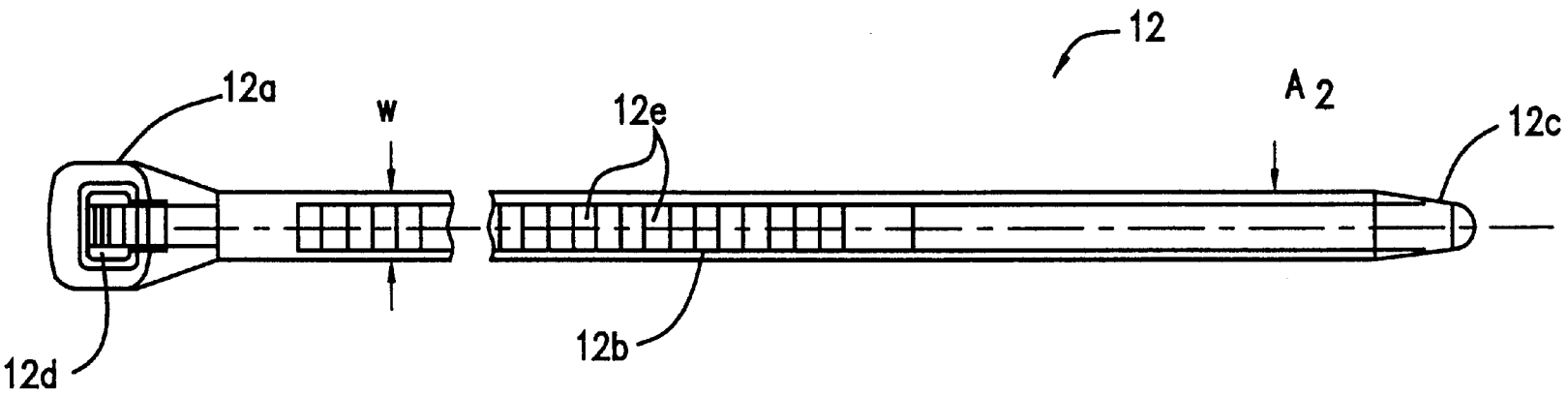
FIGS. 2A and 2B show a top view and a side view, respectively, of a symmetrical cable tie which may be used with the present invention.
Figure 2B:
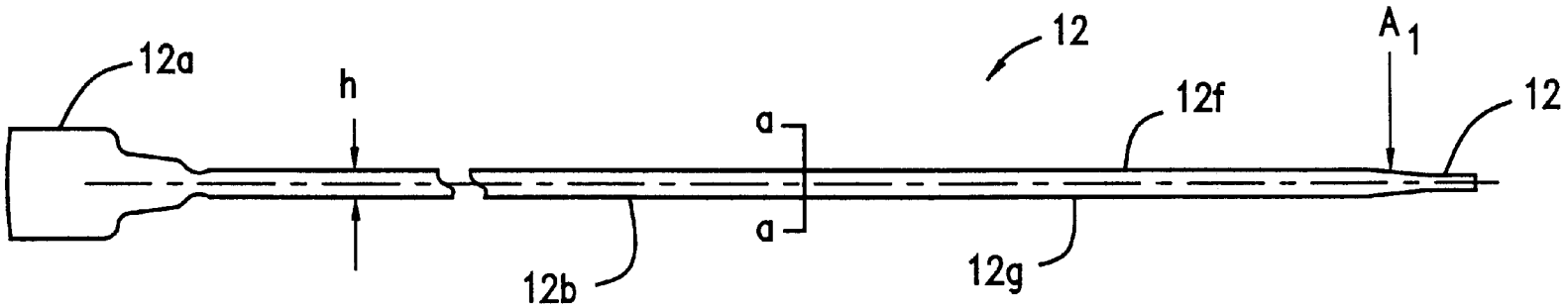

Referring again to FIGS. 2A and 2B, a cable tie 12 used in conjunction with preferred embodiment of the present invention is shown. Cable tie 12 is may be of the type shown and described in commonly assigned U.S. Provisional Patent Application Ser. No. 60/066,128, filed Nov. 21, 1997 and generally referred to as a symmetrical cable tie. Cable tie 12 is generally integrally formed of a suitable molded plastic such as nylon. Cable tie 12 includes an elongate cable tie strap body 12*b* terminating at one end in a cable tie tail 12*c* and at the other end in a cable tie head 12*a*. Cable tie strap body 12*b* is generally a planar member having a plurality of notches or teeth 12*e* extending along each of opposed planar surfaces 12*f* and 12*g* thereof. Cable tie head 12*a* includes an elongate aperture 12*d* therethrough for insertably accommodating the cable tie tail 12*c* therethrough.

Figure 5:
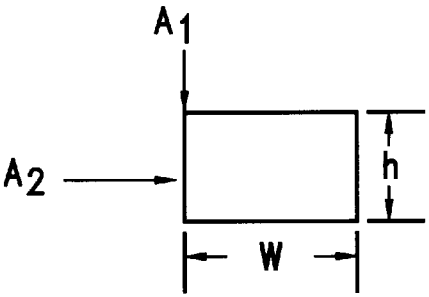
FIG. 5 shows a cross-section of the cable tie illustrated in FIG. 2B taken along line a—a.

Body 12*b* of cable tie 12 generally has a rectangular configuration. Such rectangular configuration defines a width w as particularly shown in FIG. 2A and a height h as particularly shown in FIG. 2B. The dimension of width w is significantly greater than the dimension of height h so that, as may be appreciated, along the length of cable tie 12, the cable tie is more easily deflected in the direction of arrow $A_1$, than in the direction of arrow $A_2$ as illustrated in FIG. 5A.

Figure 3B:
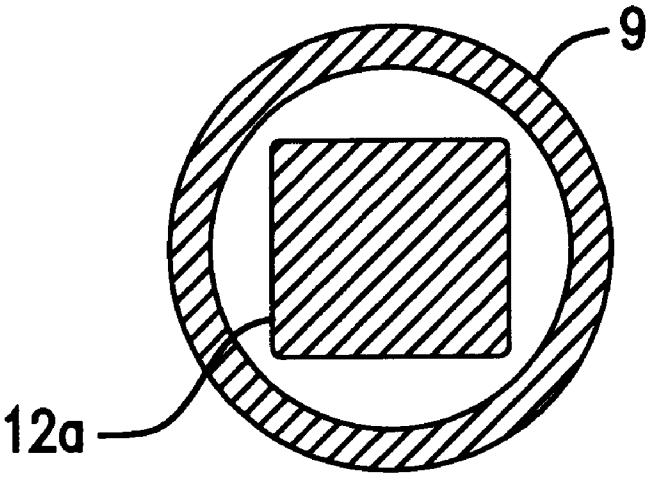
FIG. 3B shows an end view of a cable tie used with the present invention disposed in a conduit of circular cross-section.
Figure 3A:
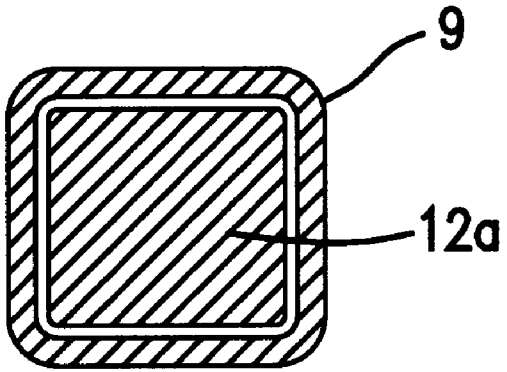
FIG. 3A shows an end view of a cable tie used with the present invention disposed in a conduit of rectangular cross section.

Referring to FIGS. 3A and 3B, capture of cable tie 12 in a horizontal position is shown to be dependent upon the inner surface geometry of a tool conduit through which the tie travels. The tool conduit is preferably a rigid chute which is machined to conform to the parameters of cable tie head 12*a* as shown in FIG. 3A thereby maintaining clearance between the cable tie and the interior surface of the conduit so as to prevent jamming of the cable tie therein. Concurrently, rotation of the cable tie is prevented so that delivery of the tie will progress with the tie in the properly oriented horizontal position. FIG. 3B, on the other hand, shows cable tie head 12*a* traveling through cylindrical delivery hose 9, wherein it is free to rotate from an undesirable vertical position to a desirable horizontal position, yet is also free to continue rotation back to such vertical position.

Figure 1:
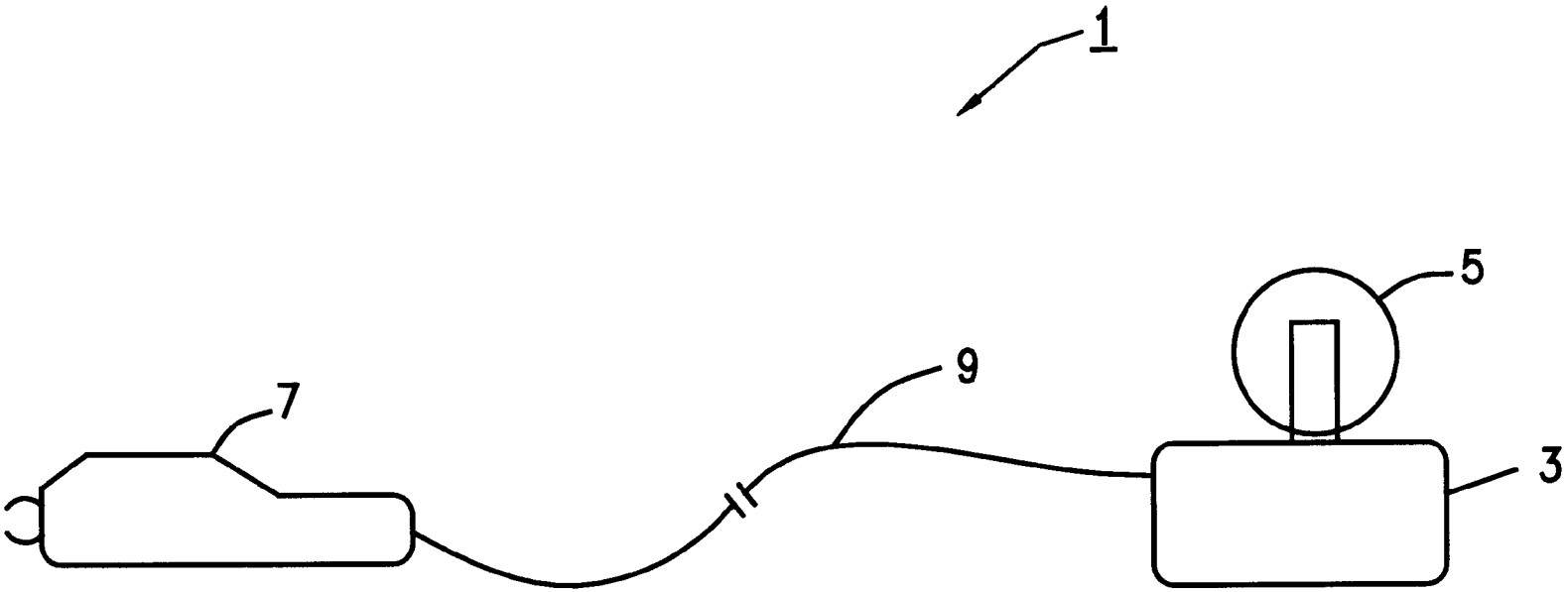
FIG. 1 shows a schematic of a cable tie delivery system which utilizes the orientation means of the present invention.
Figure 4:
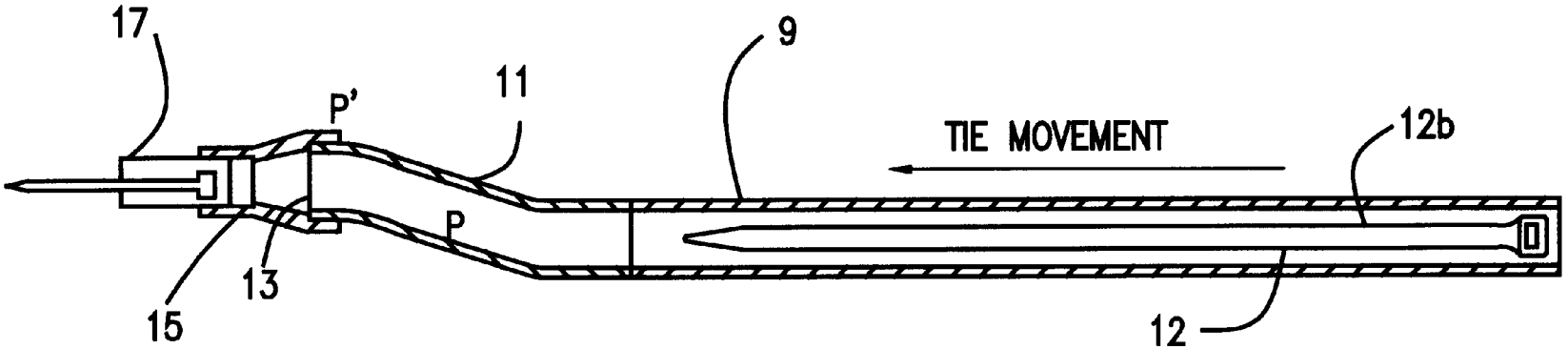
FIG. 4 shows a schematic view of delivery of a cable tie from a cable tie dispenser to a single-bend embodiment of the present invention.

Now referring to FIG. 4, a single-bend embodiment of the present invention can be described. FIG. 4 shows delivery of a symmetrical cable tie 12 through a delivery hose 9 from a cable tie dispenser shown in FIG. 1 to a cable tie installation tool 7 (shown in FIGS. 1 and 9). To re-align tie 12 after it exits delivery hose 9, an orientation conduit 11, which is bent at an angle in at least one place, is inserted in the tie path at the approximate point where tie 12 enters the installation tool.

Figure 4A:
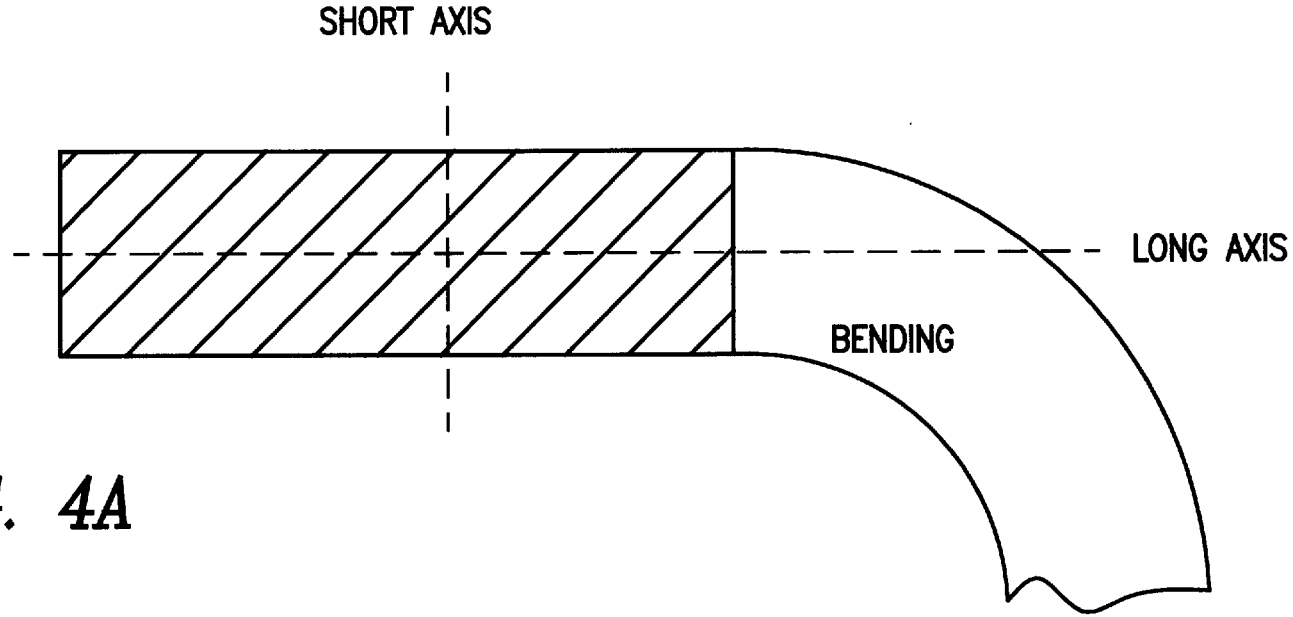
FIG. 4A shows an example of a bent extension having a long axis, about which rotation of an elongated cable tie occurs, and a short axis perpendicular thereto.

The orientation conduit 11 is preferably a rigid chute that allows the symmetrical cable tie to become realigned prior to entry into the installation tool. The direction of a point on the tie is in curvilinear motion and is therefore tangent to the path of the point. Thus, as the tip of the moving tie hits a location P defined on the interior surface of orientation conduit 11, tie body 12*b* is forced to bend. Since body 12*b* is substantially rectangular, it bends more readily around the long axis of a bent portion than around the short axis thereof, as depicted in FIG. 4A. Then, when the tie hits location P, the body happens to be in vertical alignment and rotates toward a more horizontal position because it more easily bends to follow the contour of the bent tube. The tie then stops at the far end of the tube and is ready for installation.

Deflection of a simple beam such as that defined by cable tie 12 is a function of the force or load applied to the beam, the length of the beam, the modulus of elasticity of the beam as well as the moment of inertia. The moment of inertia I, which is the resistance to angular acceleration, is defined by the relationship $I=\frac{1}{12}bh^3$, where h is the height or thickness of the beam in the direction of bending and b is the base of the beam. As can be appreciated from FIG. 5, the moment of inertia or resistance to angular acceleration substantially increases in cubic relation with the height or thickness of the strap. Thus, any load applied to one end of the beam forming cable tie 12 would tend to more readily deflect the beam in the direction of arrow $A_1$ and, therefore, the cable tie would have the tendency to rotate to a position where the load is applied in such a direction so as to deflect the cable tie.

Referring again to FIG. 4, this principle may be applied to assure a given orientation of the cable tie as it passes through a bent extent of a conduit. FIG. 4 shows orientation conduit 11 as a bent extent of delivery hose 9. Delivery hose 9 is of circular configuration. As cable tie 12 is propelled through hose 9 under pneumatic pressure, tail 12*c* of the cable tie would contact the inner wall of the orientation conduit 11 of hose 9. When the tie hits location P, the tie body is in vertical alignment as shown. The tie rotates to a horizontal position because it more easily bends to follow the contour of the elongated conduit. The contact of the progressively moving cable tie against the inner wall of orientation conduit 11 causes a load to be applied adjacent tail 12 of cable tie 12. Such a load causes the cable tie to bend or deflect along the cable tie body 12*b*. As mentioned above, as the beam formed by the cable tie will more readily bend or deflect in direction of arrow $A_1$ of FIG. 5, such an applied load will therefore have a tendency to twist or rotate the cable tie within the orientation conduit 11 so as to permit bending in that direction. As the cable tie can only pass through orientation conduit 11 of hose 9 by bending or deflecting, and as cable tie 12 will have a tendency to rotate so that the load deflects the cable tie in the direction of arrow $A_1$, the cable tie will exit orientation conduit 11 in the position where the tie is essentially "lying flat"; that is, the tie is horizontal. If the cable tie is positionally captured as it exits orientation conduit 11, positional orientation of the cable tie can be maintained. The length of orientation conduit 11 must be such that cable tie 12 would engage the inside radius of the conduit at two longitudinally spaced locations P and P'. The relationship between the length of orientation conduit 11 and the length of cable tie body 12*b* is such that due to the movement of the cable tie through hose 9, the load will be placed on the tail of cable tie 12*c* upon contact with orientation conduit 11.

Capture of cable tie 12 with a desirable orientation must be achieved during the rapid delivery of the tie to a cable tie installation tool, yet must be timed to coincide with completion of the tie's rotational movement. Capture can be achieved by engaging the periphery of orientation conduit 11 at cable tie delivery egress 13 with a transition fitting 15. Transition fitting 15 is affixed at one end to orientation conduit 11 and concurrently affixed at an opposing end to a separate tool conduit 17 that enables transport of cable tie 12 as the tie lays in a preferably horizontal position.

Figure 6:
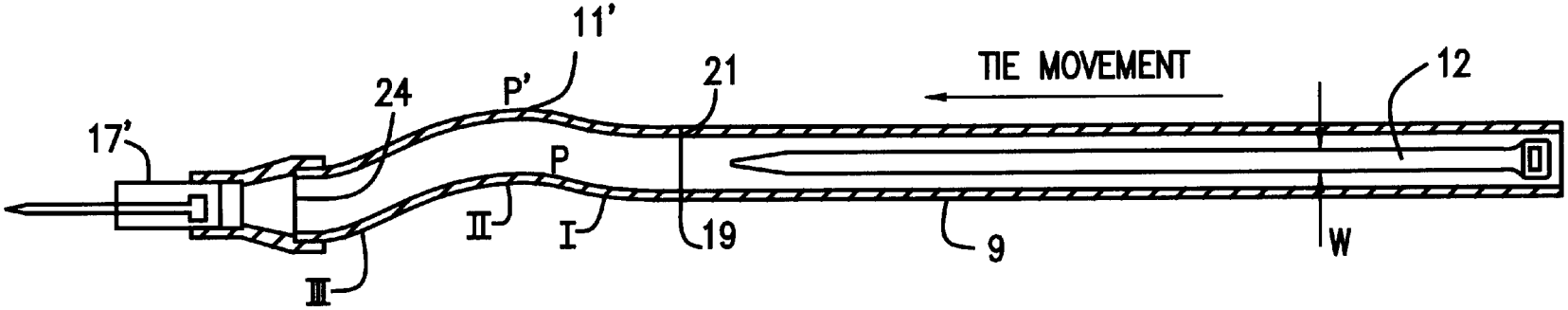
FIG. 6 shows a schematic view of delivery of a cable tie from a cable tie dispenser to a dual-bend embodiment of the present invention.
Figure 6A:
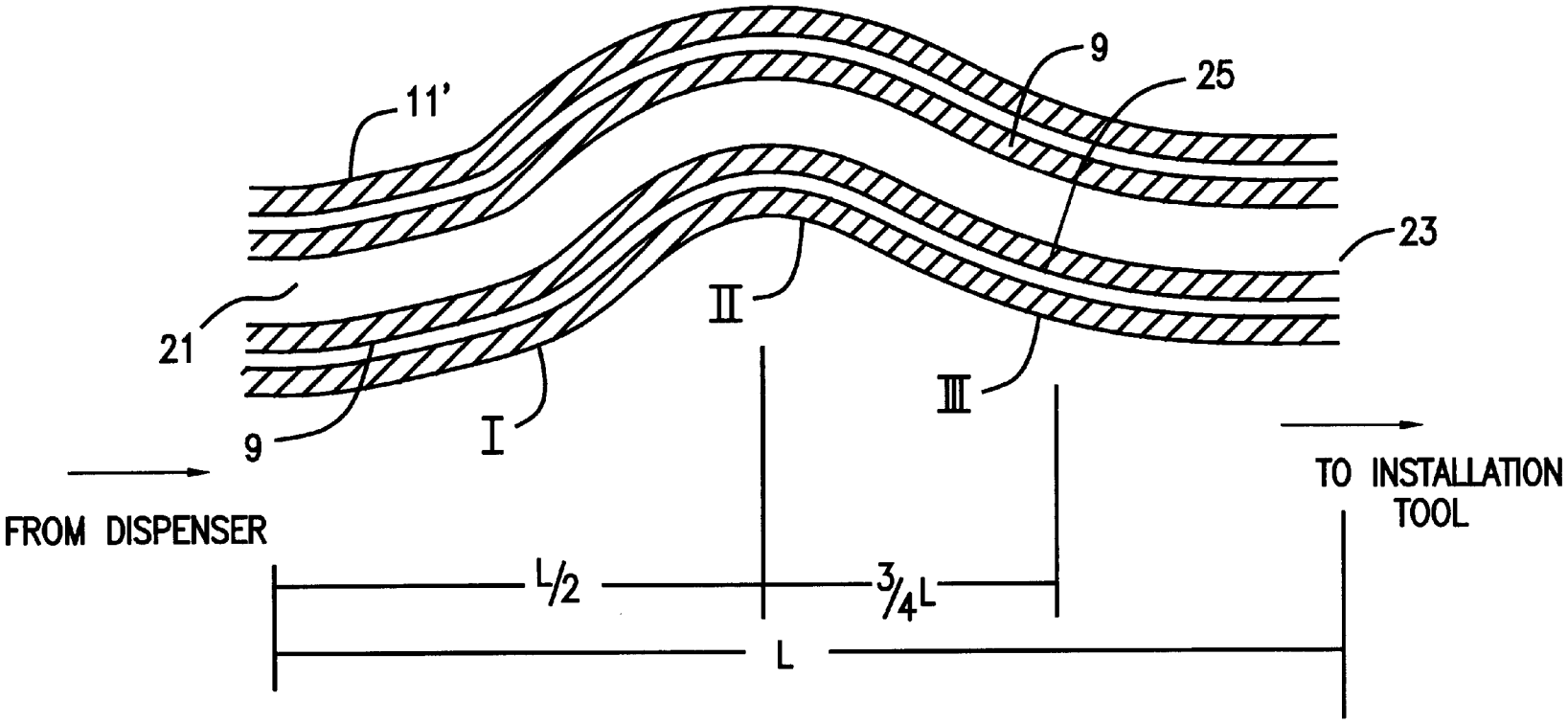
FIG. 6A shows a cross-section of the dual-bend embodiment of FIG. 6 having a conduit of cylindrical cross-section disposed therein.

Referring now to FIGS. 6 and 6A, a dual-bend embodiment of the present invention is shown. Round delivery hose 9 is shown with cable tie 12 therein. The tie may be injected in an incorrect position. This incorrect position is defined by the cable tie body 12*b* being vertical as shown in FIG. 6, i.e. the width w shown in FIG. 6 extends vertically. A cable tie delivery end 19 of the hose 9 is attached to a dual-bend orientation conduit 11'. In the present embodiment, a rigid, preferably metal, orientation conduit 11' having triple angle, I, II and III is shown. The triple angle of the dual-bend orientation conduit 11' is such that it defines an entry opening 21 at a first end and an exit opening 23 at a second end parallel thereto and spaced therefrom by the length of the conduit interposed therebetween. As tie 12 is propelled through delivery hose 9, the tail 12*c* engages the inner walls of the first bend. Such engagement applies a load to the tie body 12*b*, tending to deflect the tie body. The second bend helps to consolidate this alignment and ensure that the head of tie 12 is oriented properly as it goes through a transition fitting and enters a rectangular tool conduit inside the installation tool. As noted above, due to the increased moment of inertia created by the tie body in the vertical position shown herein, the tie has a tendency to rotate in a horizontal position where deflection is more easily achieved.

As further shown in FIG. 6A, dual-bend orientation conduit 11' houses flexible delivery hose 9 therein, wherein delivery hose 9 defines an interior circular cross section. Cable tie 12 travels through the hose and is subject to rotation throughout its trek until the tie reaches a round-to-square transition 25. In the embodiment shown in FIG. 6, the transition 25 may be effected by coupling cylindrical hose 9 to rectangular tool conduit 17' which provides a surface that conforms to the shape of cable tie head 12*a*. Dual-bend conduit 11' is accordingly machined with an inner surface geometry which accommodates the circular outer surface of delivery hose 9 and the periphery dimensions of tool conduit 17' attached thereto. However, as shown in FIG. 6A, dual-bend conduit 11' may have an inner surface machined into the material, which not only accommodates the parameters of delivery hose 9, but also provides a round-to-square transition 25, negating the need to couple a separate element to delivery hose 9.

As cable tie strap 12 enters dual-bend conduit 11' from the round dispenser tube, the bends in the orientation means orient the cable tie into a horizontal position in which the cable tie is either "heads up" or "heads down". If a symmetrical cable tie is used, as contemplated, a "heads up" or "heads down" position will make no difference as to the installation of the cable tie. Before the strap leaves the last bend, the head becomes captured at the round-to-square transition 25 and remains in this captured position via the square tube that delivers the now properly positioned cable tie to the jaws of the installation tool.

Accurate repeatability of retention of cable tie 12 within a proper horizontal position is achieved when the transition 14 is located at about ¾ of the length of the dual-band conduit 11, shown in FIG. 6A. However, this same orientation and capturing feature is predicted when the transition is located anywhere beyond one-half the length of the orientation tube.

Figure 7:
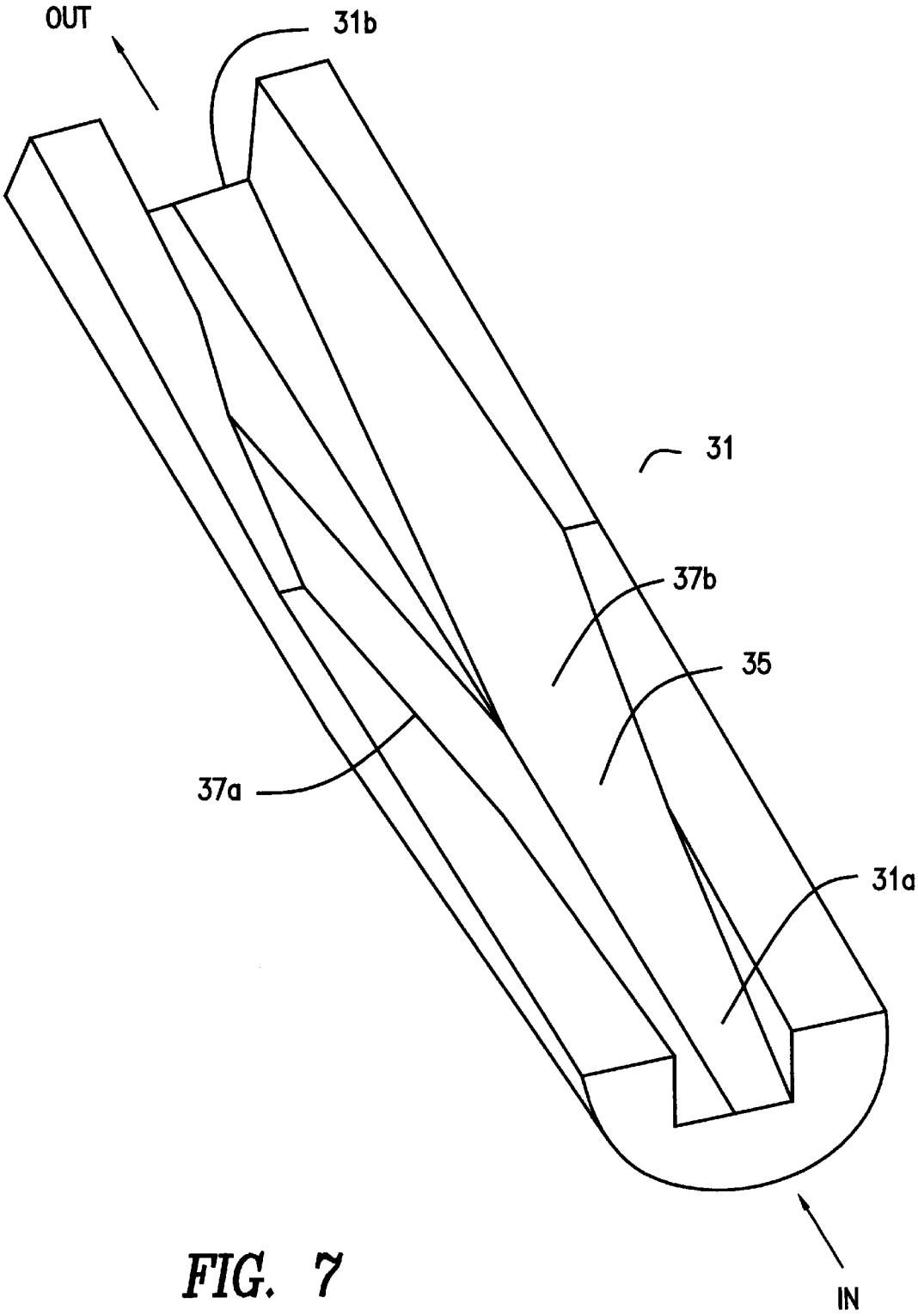
FIG. 7 shows a top perspective view of an orientation conduit of the present invention for orientation of a single-directional cable tie.
Figure 8:
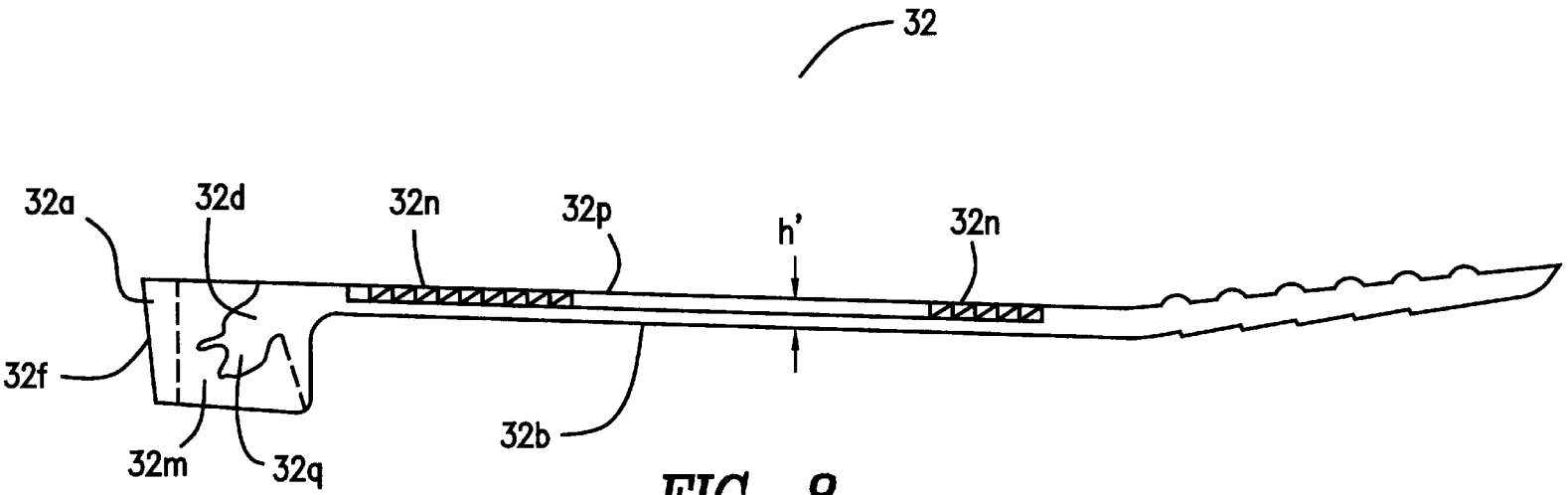
FIG. 8 shows a side view of a single-directional cable tie used with the orientation conduit shown in FIG. 7.
Figure 8A:
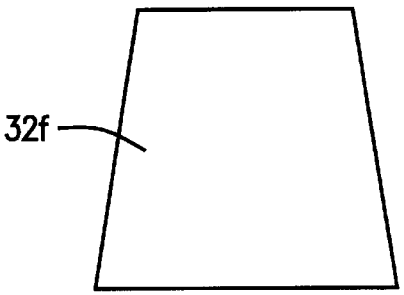
FIG. 8A shows a front view of the cable tie shown in FIG. 8 having a substantially trapezoidal head.

Now referring to FIG. 7, an alternate orientation conduit 31 is shown. Orientation conduit 31 receives a single directional cable tie such as cable tie 32 disclosed in commonly assigned U.S. Pat. No. 5,317,787 and illustrated in FIGS. 8 and 8A. Cable tie 32 is generally an elongate plastic member similar to cable tie 12 shown and described hereinabove. Cable tie 32, however, has an integrally molded barb 32*d* which extends into an aperture 32*m* in a head portion 32*a*. Head portion 32*a* defines a substantially symmetrical trapezoidal top face 32*f* as illustrated in FIG. 8A. Cable tie 32 also includes a longitudinally extending plurality of teeth 32*n* along surface 32*p* of strap body 32*b*. Barb 32*d* includes one or more barb teeth 32*q* which engage each of teeth 32*n* so as to lock strap body 32*b* into head portion 32*a* after the tie is wrapped about a bundle of articles. The locking operation of strap body 32*b* with head portion 32*a* is well known in the art.

Cable tie 12 exits hose 9 or an adjacent orientation means affixed thereto and enters a cavity 35 in orientation conduit 31. In this embodiment of the present invention, it is assumed that the cable tie has already been oriented in a "heads up" or "heads down" position. From either of these two positions, the cable tie is then oriented to the same position by rotating the tie in either the clockwise or counterclockwise direction, depending on the orientation of the tie entering the orientation conduit.

Cavity 35 defines two helical spirals 37*a* and 38*b* therein which capture tie head 32*a*, and particularly trapezoidal face 32*f*, and carry the tie head 90° to a horizontal position. The contour of the interior cavity guides the cable tie to the proper orientation for insertion and locking of teeth 32*n* into aperture 32*m* of head 32*a*. Left helical spiral 37*a* rotates right-handed and right helical spiral 37*b* rotates left handed. The pitch of each spiral is identical, thereby corresponding to the angular symmetry of trapezoidal face 32*f*. As tie 32 enters an ingress 31 a in an eccentric position, tie head 32*a* is captured within the parameters of cavity 35 thereat. The expansion of cavity 35 from a narrow portion at ingress 31*a* to a progressively wider portion at egress 32*a* accommodates rotation of cable tie head 32*a* therein, guiding trapezoidal face 32*f* correspondingly from its narrow top to its wider base. The inherent inclination of face 32*f* on each of its sides matches the elongated rotation of each spiral as the cable tie progresses through cavity 35. The tie exits egress 31*b* thereby in proper alignment for positioning in and effective ejection from a cable tie installation tool. Thus, the tie exiting the cavity is oriented in the same direction every time after transfer from cable tie dispenser 3 (shown in FIG. 1) through a delivery hose 9.

Figure 9:
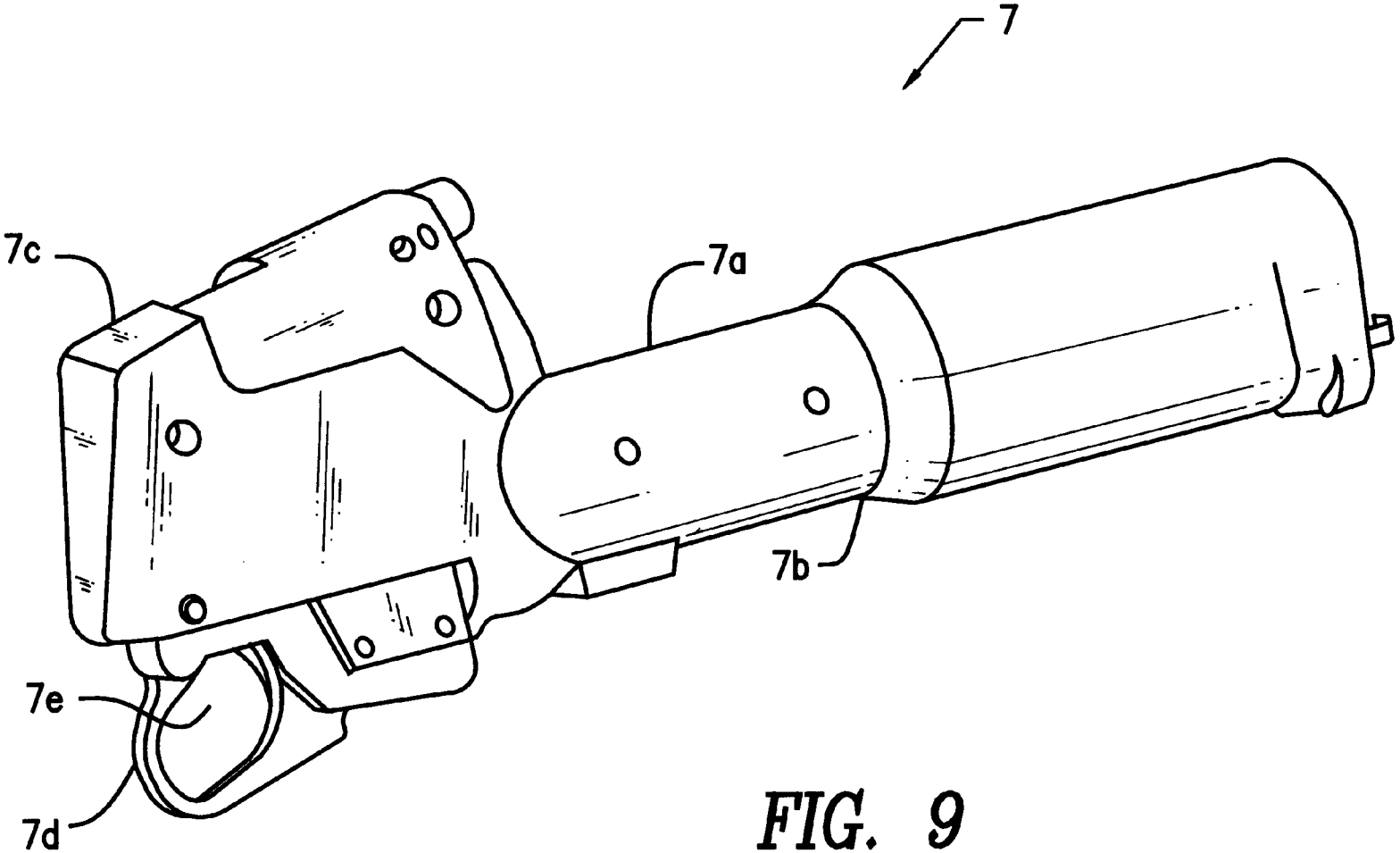
FIG. 9 shows a cable tie installation tool which may be used with the present invention.

An example of a cable tie installation tool 7 which can be used with the cable tie dispensing apparatus of the present invention is shown in FIG. 9. An automatic cable tie installation tool 7 includes a body 7*a* which supports the mechanisms contained within the tool. Rear end 7*b* of tool body 7*a* holds a connector for attachment of a flexible feed tube which, by means of propelled and compressed air, directs a cable tie into the tool. Front end 7*c* includes a push button for enabling a particular mode of operation and a housing that accommodates a movable jaw 7*d* defining a space 7*e* wherein a bundle of cables or similar articles may be inserted so that a tie may be applied therearound.

Operation of the tool is initiated by the user, preferably by retraction of a trigger on the body of the tool. When the trigger is depressed, a cable tie is immediately fired and arrives in the jaw. At the jaw, the head of the tie is guided around the wire bundle and the head hits a solid stop. Before hitting the stop, the head is decelerated and placed in proper position for firing, ensuring that the head is properly oriented to accept the threading of the tie body.

This invention allows a cable tie to be re-aligned into its proper orientation without using any moving parts. In addition, the present invention assists in preventing the collection of debris within the delivery hose, leading to fewer cable tie jams and less "down time" for maintenance.

Thus, the present invention permits a cable tie to be delivered through the orientation means of the present invention where it is propelled in a random orientation until such time as it reaches the round to square transition where passage can only be achieved in a desired orientation. As defined herein, the desired orientation is horizontal rather than a vertical orientation. It is preferable to orient the cable tie upon entry into the tool and, in that manner, it is contemplated that the flexible delivery hose is positionable within a rigid orientation means adjacent to the application tool to achieve such orientation.

Various changes to the foregoing described and shown structures would now be evident to those skilled in the art. Accordingly, the particularly disclosed scope of the invention is set forth in the following claims.

What is claimed is:

1. An orientation conduit for accurately positioning a cable tie during delivery thereof from a cable tie dispenser to a cable tie installation tool, wherein said cable tie has a generally elongate planar body with an enlarged head at an extremity thereof, said conduit comprising:

an elongate substantially rigid chute having a cable tie receiving ingress, a cable tie delivery egress and an interior surface defining an unobstructed passage therebetween and having dimensions to accommodate movement of said cable tie therethrough, said passage having a length defined by a relative distance between two discrete points wherein at least one bend is included along said length such that said cable tie body engages an inside radius of said bend at said points.

2. The orientation conduit of claim 1 wherein said ingress of said chute is offset from said egress of said chute to provide a bent extent therebelow.

3. The orientation conduit of claim 1 wherein said ingress defines a first central axis and said egress defines a second central axis.

4. The orientation conduit of claim 3 wherein said first and second central axes lie in a common plane.

5. The orientation conduit of claim 4 wherein said first and second central axes are parallel and transversely offset.

6. The orientation conduit of claim 1 further including a transition fitting affixed to said egress thereof.

7. An orientation conduit for accurately positioning a cable tie dispenser to a cable tie installation tool, wherein said cable tie has a generally elongate planar body with an enlarged head at an extremity thereof, said conduit comprising;

an elongate substantially rigid chute having a cable tie receiving ingress, a cable tie delivery egress and a substantially helical cavity therebetween, wherein said cavity defines two helical spirals comprising a left-handed helix and a right-handed helix and each of said left-handed helix and said right-handed helix extends along a length of said chute from said ingress to said egress, and wherein said left-handed helix and said right-handed helix capture said tie head and rotate said tie head to a horizontal position.

8. The orientation conduit of claim 7, wherein said ingress and said egress define a common central axis.

9. The orientation conduit of claim 7, wherein said left-handed helix and said right-handed helix have equal pitch.

* * * * *